US008966721B2

(12) United States Patent
Lane et al.

(10) Patent No.: US 8,966,721 B2
(45) Date of Patent: Mar. 3, 2015

(54) ADHERING FASTENING STRIP WITH GRIP AREA

(75) Inventors: Rodney Jay Lane, Southington, CT (US); Fred Tullock, Harwinton, CT (US); Philip J. Jackson, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 101 days.

(21) Appl. No.: 13/449,583

(22) Filed: Apr. 18, 2012

(65) Prior Publication Data

US 2013/0276271 A1 Oct. 24, 2013

(51) Int. Cl.
*A44B 18/00* (2006.01)
*A44B 99/00* (2010.01)

(52) U.S. Cl.
USPC ..... 24/442; 428/100; 24/17 R

(58) Field of Classification Search
USPC ..... 24/17 A, 17 AP, 16 PB, 30.5 P, 30.5 R, 24/450, 442, 17 R; 428/100
See application file for complete search history.

(56) References Cited

U.S. PATENT DOCUMENTS

| | | | | |
|---|---|---|---|---|
| 3,464,094 | A * | 9/1969 | Mates | 24/443 |
| 5,081,748 | A * | 1/1992 | Eberle | 24/442 |
| 5,636,503 | A * | 6/1997 | Kaspszyk | 54/23 |
| 5,868,844 | A | 2/1999 | Kato et al. | |
| 2005/0151293 | A1 | 7/2005 | Clune | |
| 2010/0192331 | A1 | 8/2010 | Caveney et al. | |
| 2011/0107559 | A1 | 5/2011 | Caveney et al. | |

* cited by examiner

*Primary Examiner* — Jack W Lavinder

(74) *Attorney, Agent, or Firm* — Ference & Associates LLC

(57) ABSTRACT

One aspect provides a fastening strip, including: a central portion comprised of a flexible material and having a first side and a second side, the first side including a first complementary material and the second side including a second complementary material, complementary to the complementary material of the first side; and a grip area disposed on at least the first side of the central portion; wherein the grip area extends substantially an entire length of fastening strip and includes a grip material. Other aspects are described.

14 Claims, 4 Drawing Sheets

ADHERING FASTENING STRIP WITH GRIP AREA

BACKGROUND

Adhering fastening strips, such as for example hook and loop ties, are generally known. Adhering fastening strips may include a first complementary material, such as a hook material, and a second complementary material, such as a loop material.

Adhering fastening strips are useful in many applications, such as for use in securing items. For example, fastening strips incorporating VELCRO material are commonly used to secure data cables. However, conventional hook and loop ties do not grip the cables sufficiently, which can place undue stress on the cables, connectors, and equipment. Hook and loop ties also tend to slide down the support/equipment that the cables are often attached to. VELCRO is a registered trademark of Velcro Industries B.V. in the United States and other countries.

Currently, cable ties and hook and loop fastening strips are used together in an attempt to secure bundles of cables. U.S. Patent Application Publication No. 20100192331(A1) presents an approach to improved bundle tensioning without risk to the bundle in which one side of a adhering fastening strip includes a large non-slip area that is flanked by a smaller first adhering material, with the opposing side of the fastening strip including a second adhering material, complementary to the first adhering material. While this approach provides some gripping by provisioning a non-slip area, it is does not provide adhering material along the length of the fastening strip, which weakens the fastening strip's adhering strength. Some other attempts, in different contexts, for pairing of gripping areas/materials with other material have been made. For example, the garment industry has used fabric impregnated with patterned silicon for support garments that would grip the skin and stay up.

Notwithstanding these approaches, there is a need to securely grip items (such as a bundle of data cables) secured by a fastening strip to keep the items from moving longitudinally with respect to the fastening strip, while still providing adequate protection from potential damage to the bundled items and still providing a fastener with adequate adhering strength.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well-known structures, materials, or operations are not shown or described in detail. The following description is intended only by way of example, and simply illustrates certain example embodiments.

Figure 1:
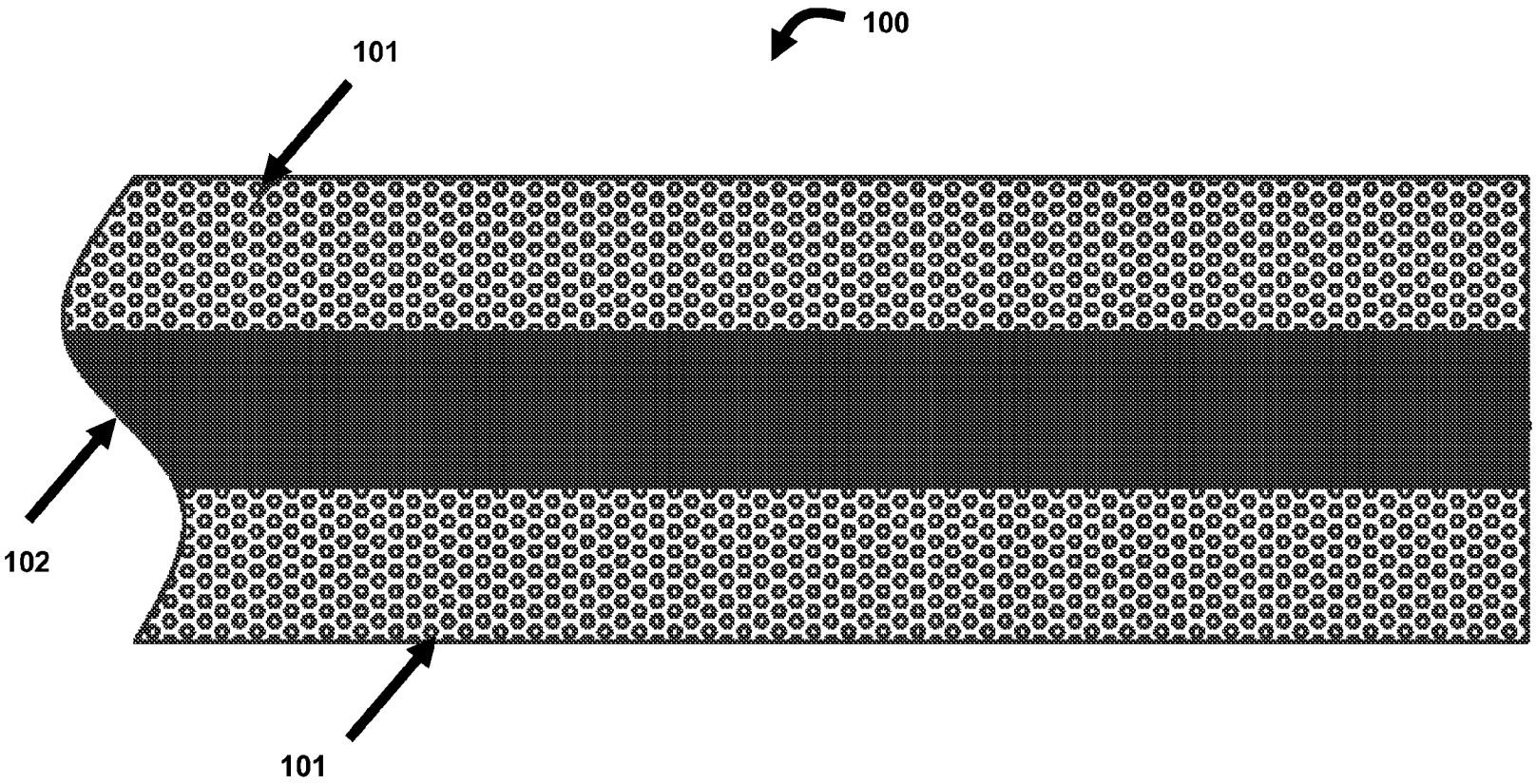
FIG. 1 illustrates a first side of an example adhering fastening strip with a grip area.
Figure 2:
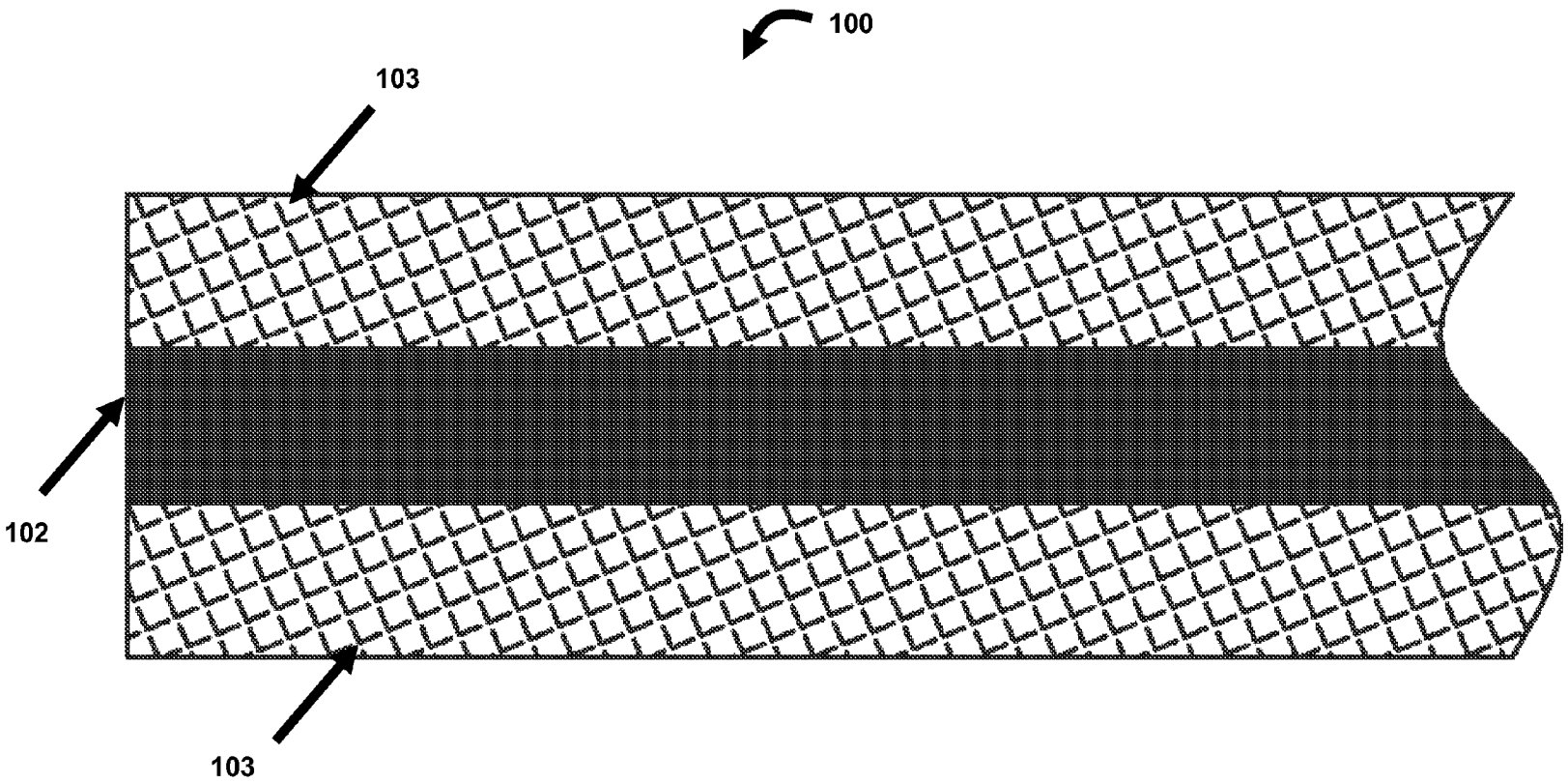
FIG. 2 illustrates a second side of an example adhering fastening strip with a grip area.

Referring to FIG. 1 and FIG. 2, an embodiment provides for an adhering fastening strip, such as a hook and loop tie 100, having at least one grip area 102. While a hook and loop tie is used as a representative example of an adhering fastening strip throughout, it will be readily understood that the principles, aspects, and characteristics described in connection with the example of a hook and loop tie may be extended to essentially any adhering/complementary fastening strip or material. In this regard, the two opposing sides of a fastening strip, such as the sides of the example hook and loop tie 100, contain complementary regions, with the complementary regions containing complementary materials. Complementary materials are materials that attach (adhere) to each other securely and may be disconnected and re-attached due to the material properties or mechanical construction of the complementary materials. Complementary materials may be a material designed to adhere to another sample of the same material, such as, for example, "mushroom-type" fasteners, or may be two different materials designed to adhere to each other such as, for example, hook and loop fasteners. Other examples of complementary/adhering materials include complementary zipper materials, magnets, and semi-adhesives.

In an example embodiment, hook and loop tie 100 may have on one side, illustrated in FIG. 1, loop portions 101, and on another side, hook portions 103, illustrated in FIG. 2. The hook and loop tie 100 may have a central portion, and may be substantially ribbon shaped such that the first side and the second side account for a majority of the surface area (refer collectively to FIG. 1, FIG. 2 and FIG. 3). The hook and loop tie 100 may include a first side, illustrated in FIG. 1, and a second side, illustrated in FIG. 2, that are substantially covered by one or more of the hook portion 103 and the loop portion 102. Again, other or additional complementary materials may be utilized to provide an adhering character to a fastening strip.

In the example illustrated in FIG. 1, a first side of the hook and loop tie 100 includes loop portion 101 having a plurality of loops. The loops in the loop portion 101 are configured to attach in a releasable fashion to hooks of a hook portion 103 of a second side of the hook and loop tie 100. The loops of the loop portion 101 may be knit loops, woven or non-woven textiles, or any material generally suitable to attach to hooks.

Alternatively, the first side of a tie such as tie 100 may include any adhering material that is complimentary to the second side of the tie.

Likewise, the hook portion 103 includes hook fabric, such as nylon or polypropylene hook fabric or other materials capable of engaging loops on the loop portion 101. Again, the second side of the tie may include any adhering material that is complementary to the first side. In the example illustrated, the loop portion 101 and the hook portion 103 are interchangeable. Example material suitable for use in the hook and loop tie 100 hook portion 103 and loop portion 101 is VELCRO material.

A grip area 102 includes a grip material. The grip area 102 configuration as well as the grip material may be suitably chosen to prevent slippage of item(s), for example data cables, secured by a fastening strip such as the hook and loop tie 100, as further described herein (refer to FIG. 4). Grip material may be a non-adhesive material that has a higher coefficient of friction as compared to complementary portions, such as the example hook portion 103 and loop portion 101 (or higher coefficient of friction as compared to other adhering materials, as the case may be). Additionally, grip material of grip area 102 may be chosen with a particular use case in mind. For example, grip material of grip area 102 may be chosen to be resistant to cold temperatures (for example, below 0° C.).

The grip area 102 may thus include a material with a softness of 20 or less on the Shore A scale (ASTM D2240-05 (2010) Standard Test Method for Rubber Property—Durometer Hardness—hereinafter "type A" scale). Texture may be added to increase grip. It is also desirable that the grip material adhere well to the central material, either on its own, or via an effective adhesive. Example grip materials include but are not limited to rubber, silicone, urethane, vinyl, or a suitable combination of the foregoing. In one embodiment, a grip material for use in grip area 102 is selected for interfacing with (gripping to) the outer coating of a data cable and equipment associated therewith, such as a metal support. An example material suitable for such an application includes silicone.

Referring to FIG. 3 (A-D), end-on views of example embodiments are illustrated. The grip area 102 may be formed as a central portion of hook and loop tie 100 on each side such that it essentially bifurcates each of loop portion 101 and hook portion 103. However, it should be noted that although one centrally located grip area 102 is illustrated on each side of the hook and loop tie 100 in some of the example embodiments, the grip area 102 may be located elsewhere, solely on one side, or more than one grip area 102 may be included on one or both sides. For example, a front side may include the grip area 102, a back side may include the grip area 102 or both the front and back sides may include the grip area 102. In this regard, "front" and "back" sides are relative terms indicating that they are opposite sides of the central portion of the hook and loop tie 100, but otherwise these terms may be considered as interchangeable. In some embodiments, the grip area may be a patterned grip area where grip material is disposed in discrete portions on a fastening strip, such as in a pattern on one or both sides of a fastening strip.

Figure 3D:
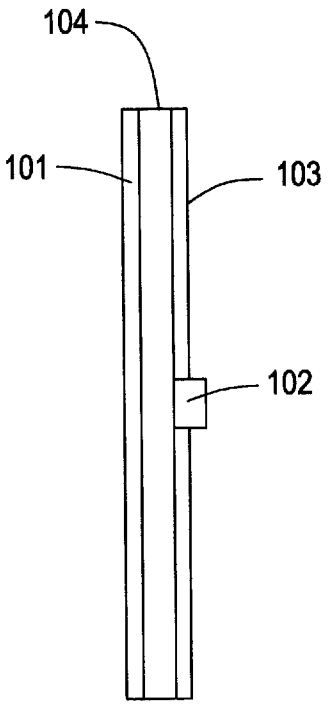
FIG. 3 (A-D) illustrates end views of example adhering fastening strips with grip areas.
Figure 3C:
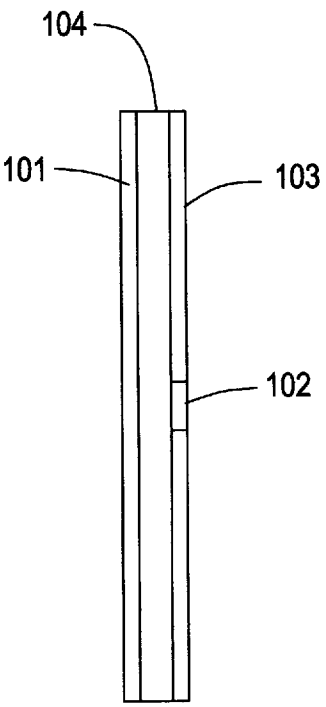
Figure 3B:
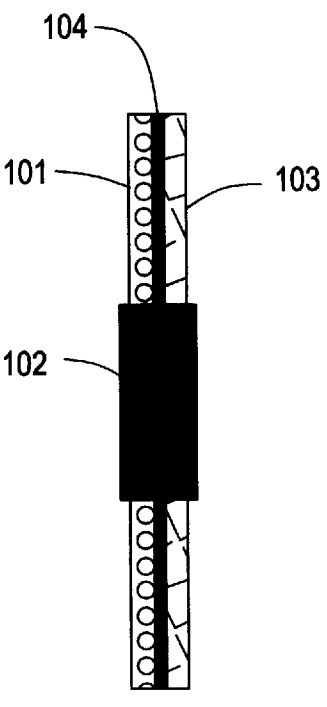
Figure 3A:
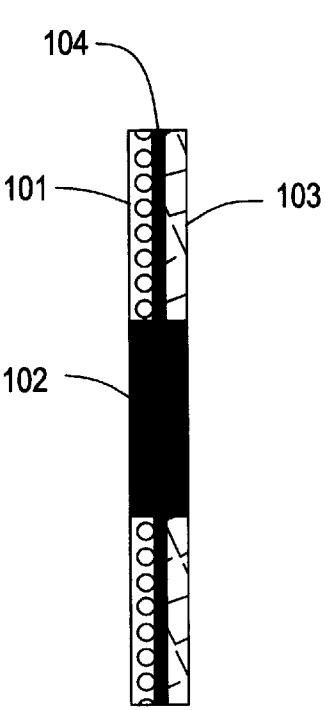

As illustrated in FIG. 3A, grip area 102 grip material may be substantially flush with the surrounding loop portion 101 or hook portion 103. In this case, the grip material may engage the object being gripped when the hook and loop portions are engaged, so that their combined thickness is less than their individual thicknesses. In another embodiment, as illustrated in FIG. 3B, grip area 102 grip material may be fashioned to protrude above loop portion 101 or hook portion 103, such as by forming grip area 102 grip material on top of one or more of the loop portion 101 and hook portion 103.

With reference to FIG. 3 (C-D), it can be appreciated that one or more of the grip area 102, loop portion 101, and hook portion 103 may be adhered to a central portion 104. The central portion may have the loop portion 101, grip area 102 and hook portion 103 affixed thereto via a variety of mechanisms. For example, the loop portion 101, grip area 102, hook portion 103, and central portion 104 may be stitched, bonded or glued to one another. The central portion 104 may comprise a polymer film, for example polyester or other materials suitable to support the other components of the hook and loop tie 100.

Alternatively, the central portion 104 may be integral to another portion, such as the hook portion 103. For example, the hook portion 103 having an integral central portion 104 or backing portion may be attached to the loop portion 101 using a permanent adhesive, stitching, et cetera.

From FIG. 3C and FIG. 3D it can be appreciated that grip area 102 may be provided on one side of a hook and loop tie 100. In FIG. 3C, grip area 102 is disposed on a hook portion 103 of a hook and loop tie 100 to have grip material be substantially flush with hook portion 103. In FIG. 3D, grip area 102 is disposed on a hook portion 103 of a hook and loop tie 100 and configured to provide grip material that protrudes above hook portion 103. In such one sided configurations, in use the portion including the grip area 102 and gripping material thereof, the hook portion as illustrated in FIG. 3 (C-D), is positioned to face the item(s) to be secured, for example a cable bundle and associated equipment. The grip area 102 may be included on the hook side, the loop side, or both. As described herein, the grip area 102 or grip material thereof may be patterned, such as a plurality of strips, dots, dashes or other discrete portions provided on one or both sides of a fastener.

Figure 4:
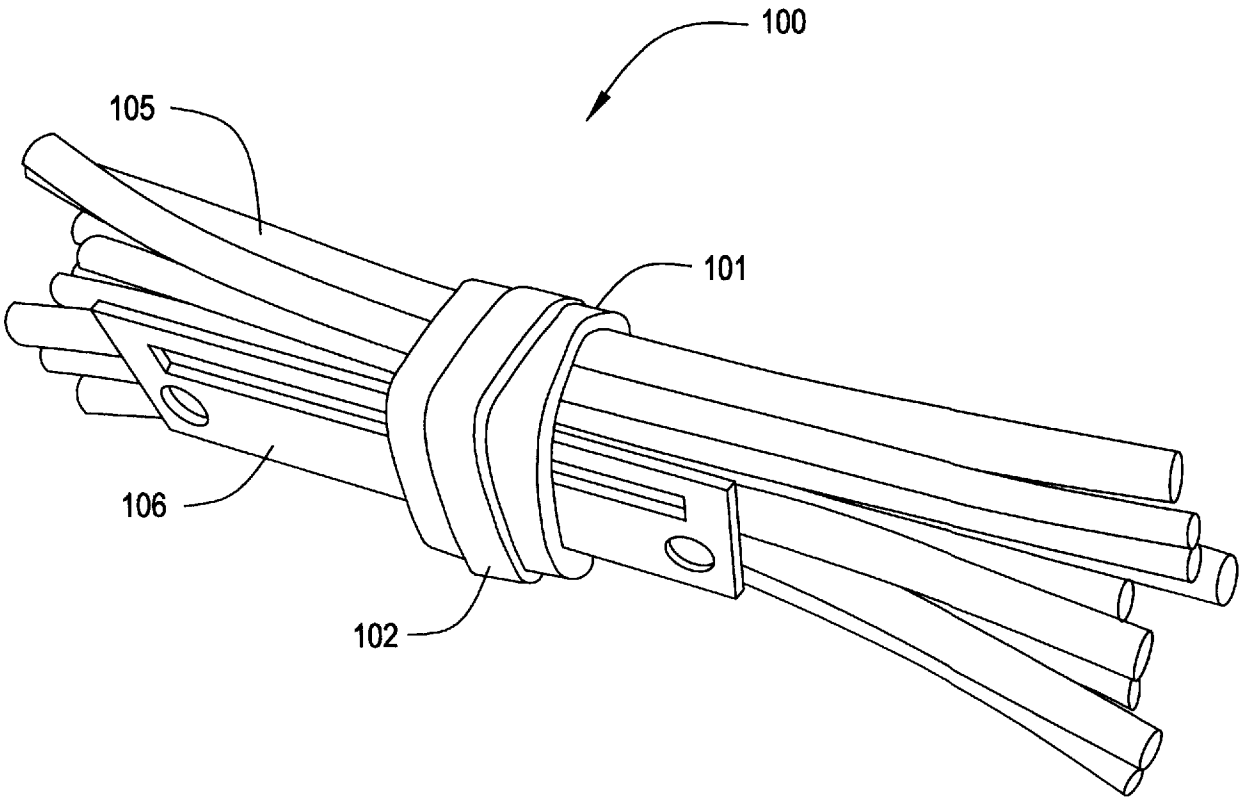
FIG. 4 illustrates an example adhering fastening strip with a grip area securing a bundle of cables to a piece of equipment.

An example hook and loop tie 100 bundling a plurality of cables 105 to a piece of equipment 106 is illustrated in FIG. 4. Hook and loop tie 100 is illustrated as wrapped around the plurality of cables 105 and equipment 106, having a loop portion 101 and a grip area 102 disposed thereon (and disposed on an underlying hook portion). Loop portion 101 attaches to an underlying hook portion 103 (which comprises the other side of the hook and loop tie 100) by virtue of the hook and loop tie 100 being wrapped around the plurality of cables 105 and equipment 106.

As shown in the figures, the grip area 102 may be disposed on the loop portion 101. In embodiments, the grip area 102 may be disposed on the hook portion 103. The grip area 102 is disposed, for example centrally, on either side of the fastening strip, or both. The grip material is disposed in the grip area 102. The grip material of the grip area 102, in the example of a hook and loop tie 100, may be on top of the hook or loop material or in direct contact with the central material, for example if there is no hook or loop material in the grip area 102. The grip area 102 may be a central strip, as in the illustrated examples of the figures; however, the grip material may be in the in another form, such as described herein.

The grip area 102 protrudes from (and above) loop portion 101 and an underlying hook portion in the example illustrated in FIG. 4. Grip area 102, when hook and loop tie 100 is wrapped snugly around the plurality of cables 105 and equipment 106, contacts some of the plurality of cables 105 with a higher coefficient of friction as compared to loop portion 101 of hook and loop tie 100. Thus, inclusion of grip area 102 provides improved stability to the bundling arrangement and provides a secure yet gentle/cushioned fastening means due to the gripping material, which may for example include silicone. This allows a plurality of cables 105 to be bundled, either alone or to/with equipment 106, in a secure fashion that will not damage the plurality of cables 105. The hook and loop100 tie is easily releasable for quick assembly/disassembly.

While example fastening strips have been illustrated herein, it is noted that the dimensions of the fastening strip or portions/areas thereof may be modified as suitable for particular applications. Thus, the width of the fastening strip, the regions/portions/areas of the fastening strip, and selection and thickness of the grip and complementary materials may be selected according to a specific application. For example, a relatively narrow fastening strip may be used for a low-impact application such as bundling computer cables, while a relatively wide fastening strip may be used for a high-impact application such as bundling athletic equipment for easier transportation (for example, skis).

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated. Although illustrative embodiments have been described herein, it is to be understood that the embodiments are not limited to those precise embodiments, and that various other changes and modifications may be affected therein by one skilled in the art without departing from the scope or spirit of the disclosure.

What is claimed is:

1. A fastening strip, comprising:

a central portion comprised of a flexible material and having a front side and a back side, the front side including a first complementary material and the back side including a second complementary material, complementary to the complementary material of the front side; and a grip area disposed on at least the front side of the central portion;

wherein the grip area extends substantially an entire length of the fastening strip and includes a grip material;

wherein the grip material protrudes above at least the first complementary material; and wherein the grip area is bordered on a first lateral side and a second lateral side by the first complementary material.

2. The fastening strip of claim 1, wherein the grip area comprises a grip material with a softness of not greater than 20 on the type A scale.

3. The fastening strip of claim 2, wherein the grip area comprises a grip material selected from the group consisting of rubber, silicone, urethane, and vinyl.

4. The fastening strip of claim 1, wherein a second grip area is disposed on the back side of the central portion.

5. The fastening strip of claim 1, wherein the grip area disposed on at least the front side of the central portion comprises multiple grip areas on the front side of the central portion.

6. The fastening strip of claim 1, wherein the grip area is a continuous strip.

7. The fastening strip of claim 1, wherein the grip area disposed on at least the front side of the central portion is composed of discrete portions.

8. The fastening strip of claim 1, wherein the first complementary material is one of a hook material and a loop material.

9. The fastening strip of claim 1, wherein the grip area comprises a plurality of grip areas disposed on at least the front side of the central portion.

10. The fastening strip of claim 1, wherein the central portion is substantially ribbon shaped such that the front side and the back side account for a majority of the surface area of the central portion.

11. The fastening strip of claim 1, wherein the front side of the central portion and the back side of the central portion are substantially covered by one or more of hook material and loop material.

12. The fastening strip of claim 11, wherein the grip area is provided on top of one or more of the hook material and the loop material, and further wherein the grip material protrudes above one or more of the hook material and the loop material.

13. A fastening strip, comprising:

a central portion comprised of a flexible material and having a front side and a back side, the front side including a first complementary material and the back side including a second complementary material, complementary to the complementary material of the front side; and a grip area disposed on at least the front side of the central portion;

wherein the grip area extends substantially an entire length of fastening strip and includes a grip material;

wherein the grip material protrudes above at least the first complementary material;

wherein the grip area is bordered on a first lateral side and a second lateral side by the first complementary material;

wherein the first complementary material is a hook material; and wherein the grip area is disposed between two or more hook material areas.

14. A method of providing a fastening strip, comprising:

fashioning a central portion comprised of a flexible material and having a first complementary material disposed on a front side of the central portion and a second complementary material, complementary to the first complementary material, disposed on a back side of the central portion; and providing a grip area to one or more of the front side of the central portion and the back side of the central portion;

wherein the grip area extends substantially an entire length of fastening strip and includes a grip material;

wherein the grip material protrudes above one or more of the first complementary material and the second complementary material; and wherein the grip area is bordered on a first lateral side and a second lateral side by the first complementary material.

* * * * *